US012789953B2

(12) United States Patent
Hensal

(10) Patent No.: US 12,789,953 B2
(45) Date of Patent: Nov. 10, 2026

(54) PADDLEBOARD CONNECTION

(71) Applicant: Sup Buddy, LLC, Akron, OH (US)

(72) Inventor: Jennifer Lee Hensal, Akron, OH (US)

(73) Assignee: Sup Buddy, LLC, Akron, OH (US)

( * ) Notice: Subject to any disclaimer, the term of this patent is extended or adjusted under 35 U.S.C. 154(b) by 337 days.

(21) Appl. No.: 18/584,090

(22) Filed: Feb. 22, 2024

(65) Prior Publication Data

US 2024/0286714 A1 Aug. 29, 2024

Related U.S. Application Data

(60) Provisional application No. 63/448,042, filed on Feb. 24, 2023.

(51) Int. Cl.
*B63B 32/40* (2020.01)
*B63B 32/50* (2020.01)
*B63B 32/77* (2020.01)

(52) U.S. Cl.
CPC ..... *B63B 32/40* (2020.02); *B63B 32/50* (2020.02); *B63B 32/77* (2020.02)

(58) Field of Classification Search
CPC ..... B63B 32/00; B63B 32/40; B63B 32/50; B63B 32/77; B63B 34/00; B63B 34/45; B63B 34/56; B63B 34/565
USPC ..... 441/65
See application file for complete search history.

(56) References Cited

U.S. PATENT DOCUMENTS 3,763,813 A * 10/1973 Holtz ..... B63B 34/26 114/347
4,807,551 A * 2/1989 Ace ..... B63B 1/121 114/347
5,501,169 A * 3/1996 Denker ..... B63B 34/26 114/347
5,657,713 A * 8/1997 Rowlett ..... B63B 34/20 114/61.1
8,047,153 B2 * 11/2011 Wood ..... B63B 34/20 114/61.1
8,932,095 B1 * 1/2015 Hudson ..... B63B 32/77 441/74
10,023,276 B1 * 7/2018 Sharrer ..... B63B 34/20
12,065,220 B2 * 8/2024 Eckl ..... B63B 32/77

* cited by examiner

*Primary Examiner* — Lars A Olson
(74) *Attorney, Agent, or Firm* — McDonald Hopkins LLC

(57) ABSTRACT

Disclosed embodiments pertain to a paddleboard connector. A plate can be affixed to paddleboards with an integrated receiving element. A board connector member can be removably attached to each plate through the integrated receiving element. The board connector member can include an aperture and a locking mechanism for engaging with a boom. The board connector member can include a locking mechanism that can be released to allow the board connector to receive an end of the boom through the aperture. After the first end of the boom is positioned within the aperture, the locking mechanism can be engaged to hold the boom in place. A second end of the boom can be inserted into an aperture of a second board connected and held in place by engaging the locking mechanism.

18 Claims, 11 Drawing Sheets

PADDLEBOARD CONNECTION

CROSS-REFERENCE TO RELATED APPLICATIONS

This application claims the benefit of U.S. provisional patent application No. 63/448,042, filed Feb. 24, 2023, and entitled PADDLEBOARD CONNECTION. The entirety of this application is incorporated herein by reference.

BACKGROUND

Paddleboarding is an increasingly popular recreation and fitness activity. Paddleboarding involves a paddleboard, a type of watercraft propelled by a person on the board using a paddle. Paddleboards have a flat deck and are typically wider than traditional surfboards, providing more stability and allowing riders to stand up and paddle. People can use paddleboards for yoga, touring, exploring, racing, and surfing.

Paddleboards come in a variety of sizes and designs to suit diverse needs. Some are designed for flatwater paddling, while others are built for use in waves. Inflatable paddleboards have become increasingly popular, as they are lightweight and easy to transport, but solid paddleboards are still quite common. Some paddleboards are even designed for specific activities, such as fishing or yoga. They can be made of fiberglass, epoxy, carbon fiber, wood, and even plastic.

SUMMARY

The following presents a simplified summary to provide a basic understanding of some aspects of the disclosed subject matter. This summary is not an extensive overview. It is not intended to identify necessary elements or to delineate the scope of the claimed subject matter. Rather, this summary presents some concepts in a simplified form as a prelude to the more detailed description presented later.

According to one aspect, a paddleboard apparatus includes a plate attachable to a paddleboard with an integrated receiving element, a connector member with an aperture and a releasable lock removably affixable to the plate through the integrated receiving element, and a rigid boom with a first end insertable through the aperture and held in place by the releasable lock.

In accordance with another aspect, a method of connecting paddleboards includes affixing a first plate to a first paddleboard, attaching a first connection member to the first plate through a first integrated receiving element, and inserting a first end of a boom through a first aperture of the first connection member.

According to yet another aspect, a paddleboard connection apparatus includes a plate attachable to a paddleboard with an integrated receiving element and a connector member comprising an extended portion, an aperture in a handle portion of the connector member, and a releasable locking mechanism. Further, the connector member can be removably affixable to the plate through the extended portion that interacts with the integrated receiving element. The paddleboard connection apparatus can also include an angled boom with a first end insertable through the aperture and held in place by the releasable lock.

To accomplish the foregoing and related ends, certain illustrative aspects of the claimed subject matter are described herein in connection with the following description and the annexed drawings. These aspects indicate numerous ways in which the subject matter may be practiced, all of which are intended to be within the scope of the disclosed subject matter. Other advantages and novel features may become apparent from the following detailed description when considered in conjunction with the drawings.

BRIEF DESCRIPTION OF THE DRAWINGS

The appended figures depict certain aspects and are, therefore, not to be considered limiting of the scope of this disclosure.

To facilitate understanding, identical reference numerals have been used, where possible, to designate identical elements common to the drawings. It is contemplated that elements and features of one embodiment may be beneficially incorporated in other embodiments without further recitation.

DETAILED DESCRIPTION

Figure 1:
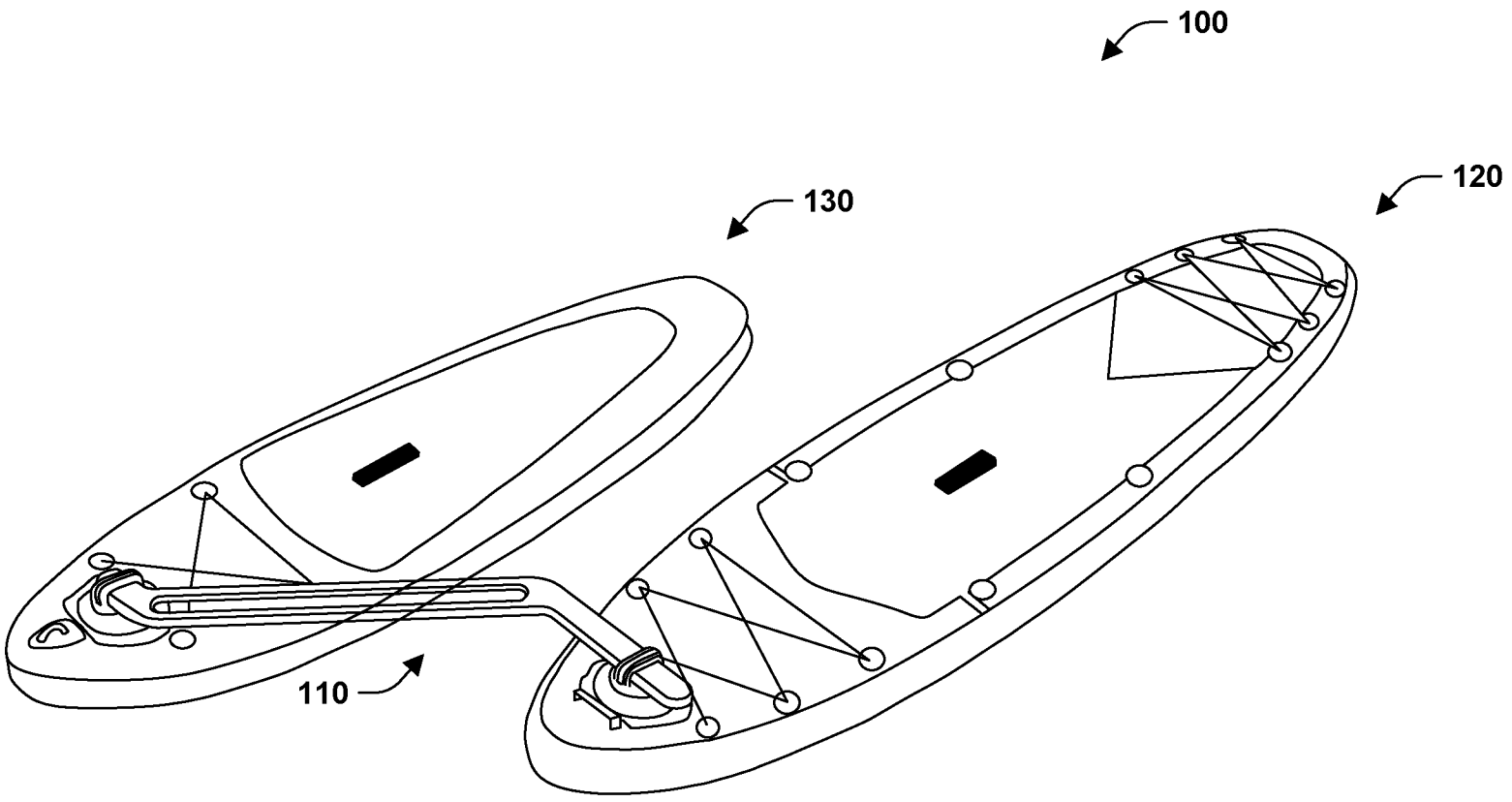
FIG. 1 illustrates a high-level view of one embodiment of a paddleboard connection.

A paddleboarder may desire to be accompanied by one or more non-paddlers on a body of water. A non-paddler can be a person who is unable to sufficiently operate a paddleboard themselves, for example, because of age, skill, or disability. In another instance, a non-paddler can be a pet, such as a dog. In yet another instance, the non-paddler can be an inanimate object, such as a bag or cooler. Further, the non-paddler may not fit on a single paddleboard or cause the paddleboard to become unstable and difficult to operate. The non-paddler cannot simply be moved to a separate paddleboard because they cannot operate it themselves. One solution is to connect two paddleboards to provide space and stability for a non-paddler. However, considerations including drag, stability, and practicality, among others, make the connection of paddleboards nontrivial.

Disclosed embodiments pertain to paddleboard connection. The paddleboard connection can connect two or more paddleboards. In one instance, a paddler can be connected with one or more non-paddlers (e.g., cargo, cooler, pet). In another instance, two or more paddlers can be connected. In one embodiment, the paddleboard connection can comprise a plate attachable to a paddleboard including an integrated receiving element. In one embodiment, the plate can low profile so as not to interfere with user experience or create a transportation problem. A connector member can be removably affixed to the paddle board by way of the integrated receiving element of the plate. The connector member can also include an aperture and a lock, which can be utilized with a boom. A first portion of the boom can be inserted through the aperture on the connector member and locked into place by the lock. A second portion of the boom can be inserted through the aperture of a second connector member affixed to a second board and held in place utilizing the lock. Distance between a first and second paddleboard can be adjusted based on the boom length inserted through the apertures of a first and second board connector. In one instance, a non-paddler such as cargo on a second paddleboard can be moved closer or farther from a first paddleboard as needed. The boom can be constructed of a rigid material to stabilize paddleboards. In one embodiment, the boom can be constructed to be lightweight and easily transportable. The boom can also be angled to allow one paddleboard to be in front of a second paddleboard for reduced drag and practicality. For example, cargo on a second board can be within view of a paddler on a first board. Other embodiments are also contemplated including a connection of more than two paddleboards.

Various aspects of the subject disclosure are now described in more detail with reference to the annexed drawings, wherein like numerals generally refer to like or corresponding elements throughout. It should be understood, however, that the drawings and detailed description relating thereto are not intended to limit the claimed subject matter to the particular form disclosed. Instead, the intention is to cover all modifications, equivalents, and alternatives falling within the spirit and scope of the claimed subject matter.

Example Paddleboard Connection Embodiment

Referring initially to FIG. 1, a high-level view 100 of one embodiment of a paddleboard connection is illustrated. The high-level view 100 includes a connection apparatus 110, a first paddleboard 120, and a second paddleboard 130. The first paddleboard 120 can be an adult paddleboard and the second paddleboard 130 can correspond to youth paddleboard. In this instance, an adult can utilize the first paddleboard and connect the first paddleboard 120 to the second paddleboard 130 occupied by a non-paddler (e.g., cargo, dog, child). In accordance with one embodiment, the first paddleboard 120 and the second paddleboard 130 can be inflatable paddleboards that can be deflated, packed and easily transported in a backpack.

The connection apparatus 110 includes an angled, rigid boom and two connection points on top of and near the front of the first paddleboard 120 and the second paddleboard 130. Each connection point includes an aperture that accepts and secures a portion of the boom. In the subject embodiment, the rigid boom is shaped like a horizontally stretched letter "S" with one end longer than the other. The position of the first paddleboard 120 relative to the second paddleboard 130 is defined by the angle of the boom of the connection apparatus 110. The angle of the boom can reduce drag, improve stability, and allow a user to maintain view of the second paddleboard 130, including a non-paddler, from the first paddleboard 120. Further, the distance between the first paddleboard 120 and the second paddleboard 130 can be based on the length of an end of the boom inserted through the aperture on the first paddleboard 120. If more of the boom is inserted, the first paddleboard 120 will be closer to the second paddleboard 130 than if less of the boom 102 is inserted. As illustrated, the first paddleboard 120 and second paddleboard 130 can be moved closer than pictured by inserting more of a longer end of the boom through an aperture on the connector member of the first paddleboard 120. For instance, a paddler on the first paddleboard 120 can move the second paddleboard 130 closer to access a non-paddler on the second paddleboard 130 and subsequently extend the second paddleboard 130 away from the first paddleboard 120 without leaving the first paddleboard 120. In one example scenario, the non-paddler can correspond to a camera or video equipment on the second paddleboard 130 can be extended away from the first board 120 to record actions, such as a yoga demonstration, on the first paddleboard 120.

Example Connection Apparatus

Figure 2:
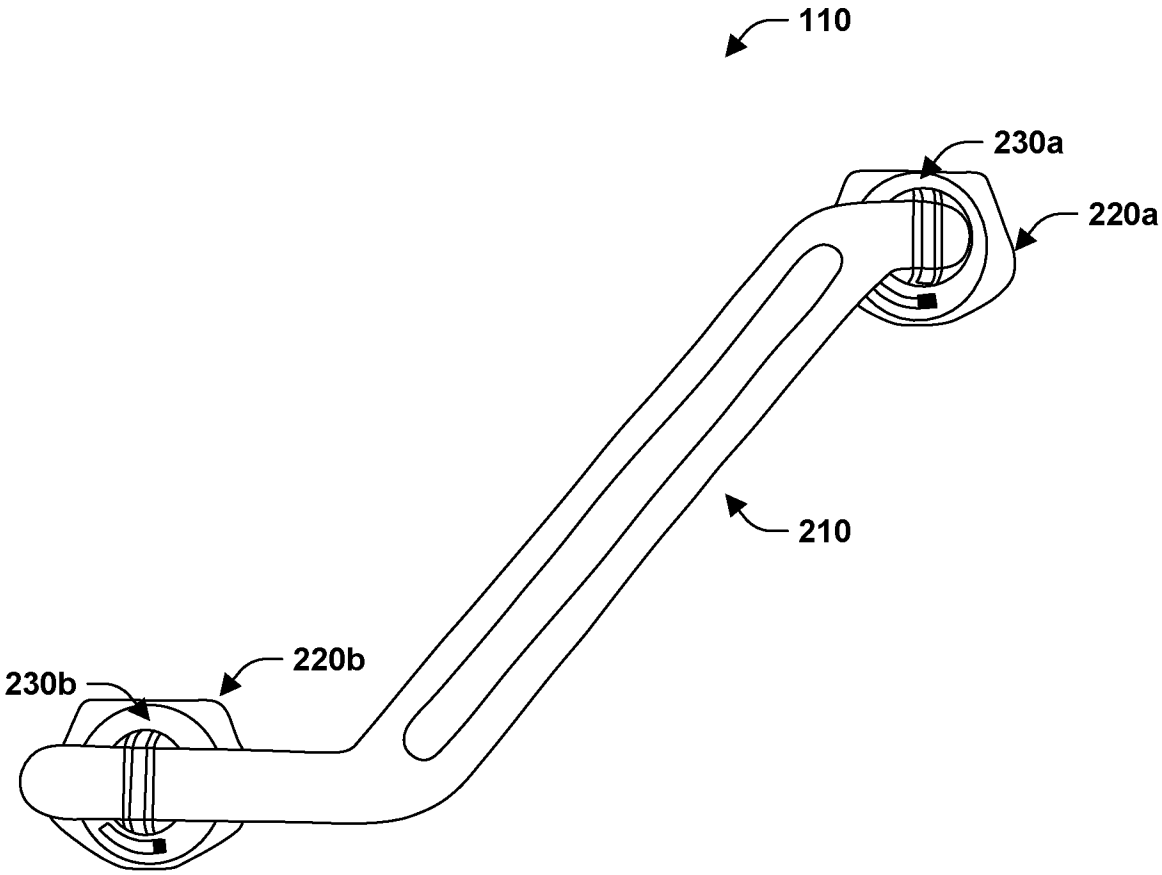
FIG. 2 depicts a connection apparatus in further example detail.

FIG. 2 depicts the connection apparatus 110 in further example detail. The connection apparatus includes the boom 210, plates 220*a* and 220*b*, and connector members 230*a* and 230*b*. The boom 210 includes three portions. The first portion is a first end, and a second portion is a second end. The first and second ends enable physical attachment of the boom 210 to connector members 230*a* and 230*b*. Here, the first end interacting with connector member 230*b* is longer than the second end interacting with connector member 230*a*. The third portion of the boom 210 is a section between the first and second ends. As illustrated, the third portion is angled to position one paddleboard in front of another when connected. Other embodiments can include different angles for desired positions. For example, the angle can be substantially zero to position paddleboards side by side. Further, the boom 210 includes an aperture 212 or slot along a length of the third portion that can at least reduce the weight of the boom 210, improving usability for installation and transportation. The weight reduction can eliminate the need for counterweights on attached paddleboards, and the aperture 212 can also act as a handle to further aid in transportation. The boom 210 can be constructed of various materials or material combinations, including, but not limited to, metal (e.g., steel, aluminum, composite), fiberglass, epoxy, resin, ceramic, plastic, wood or a combination thereof.

Plates 220*a* and 220*b* are mechanisms that attach permanently, semi-permanently, or temporarily to a paddleboard surface. In one embodiment, the plates 220*a* and 220*b* can be made of carbon fiber (sometimes called graphite fiber) which I stronger than steel and light weight. The bottom side of a plate 220 can be affixed permanently using an adhesive. Alternatively, fasteners such as screws, rivets, suction cups, magnets, hook-and-loop fabric material (e.g., Velcro), or a clamping mechanism (e.g., attached between sides or edges of a board) can be utilized to connect the plates to the paddleboards semi-permanently or temporarily. Further, the plates 220*a* and 220*b* can include integrated receiving elements to secure physical linking with connector members 230*a* and 203*b*. In one instance, the plates can include an aperture and tab that interact with portions of a connector member, such that turning a connector member locks the connector in place temporarily until it is unlocked. Of course, other mechanisms for permanent or temporary attachment are also possible.

The connector members 230*a* and 230*b* can include portions that attach to a plate by way of the integrated receiving elements. Further, the connector members can include an aperture and locking mechanism for accepting and securing an end of the boom 210. For example, a locking mechanism, such as a latch, can be opened and an end inserted through an aperture to a desired position. Subsequently, the locking mechanism can be closed or engaged to hold an end of the boom 210 in place. In one instance, the locking mechanism can utilize friction between a locking mechanism surfaces on the boom end. Other locking mechanisms can be used in addition to or as a replacement for a friction-based locking mechanism. For example, an end of the boom 210 can include various apertures, and the locking mechanism can include a pin inserted into an aperture to hold the boom in place. Furthermore, the locking mechanism can be designed to be the first point of failure in one embodiment to preserve the stability of the paddleboards and the safety of paddlers and non-paddlers if something goes wrong. The locking mechanism can designed to release after a predetermined or adjustable force is applied. For example, if the force satisfies a threshold value, the locking mechanism can release.

Example Plate and Connector Member

FIGS. 3-9 illustrate an example plate 220 and connector member 230 to aid clarity and understanding of one example embodiment. Additionally, FIGS. 3-7 illustrate example interactions between a plate 220 and a connector member.

Figure 3:
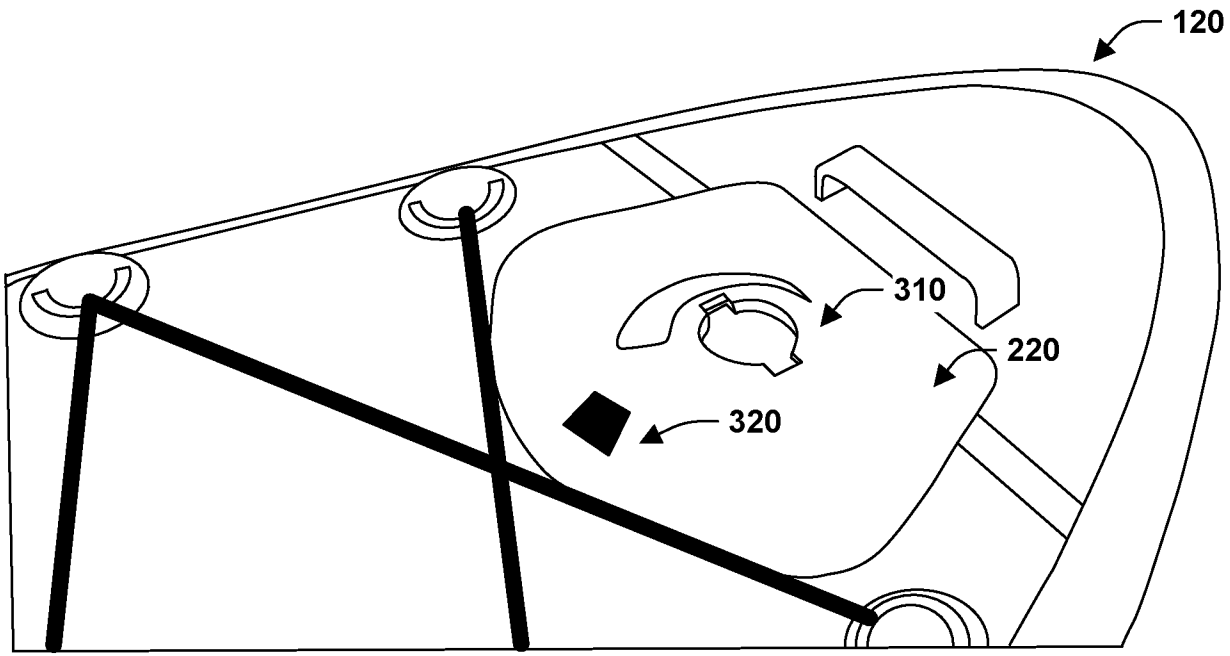
FIG. 3 illustrates an example plate affixed to a paddleboard.

FIG. 3 depicts the top section of a paddleboard 120. Further shown is a plate 220 affixed to the top surface of the paddleboard 120. The plate 220 is shown as a pentagon with rounded corners, but the plate can be substantially any shape conducive for attachment to various sizes and shapes of paddleboards. In one instance, the plate 220 can be affixed to the surface of the paddleboard 120 utilizing an adhesive between the bottom of the plate and the top of the paddleboard surface. Of course, semi-permanent or temporary fasteners can be utilized to attach the plate to the paddleboard 120. The example plate 220 has a low profile and can be formed of a carbon fiber, among other things. Furthermore, the plate 220 can include integrated receiving elements for a connector member 230. As shown, the plate 220 includes an aperture 310. The aperture 310 is circular in the middle with opposite rectangular portions or fins in a "t" shape operable to accommodate and secure a connector member 230 with a similar shape extension. The plate 220 also includes a locking tab 320 that protrudes vertically from the plate 220 and provides a secondary locking mechanism for a connector member 230. The locking tab 320 can be made of the same material as the plate 220 or a different material.

Figure 4:
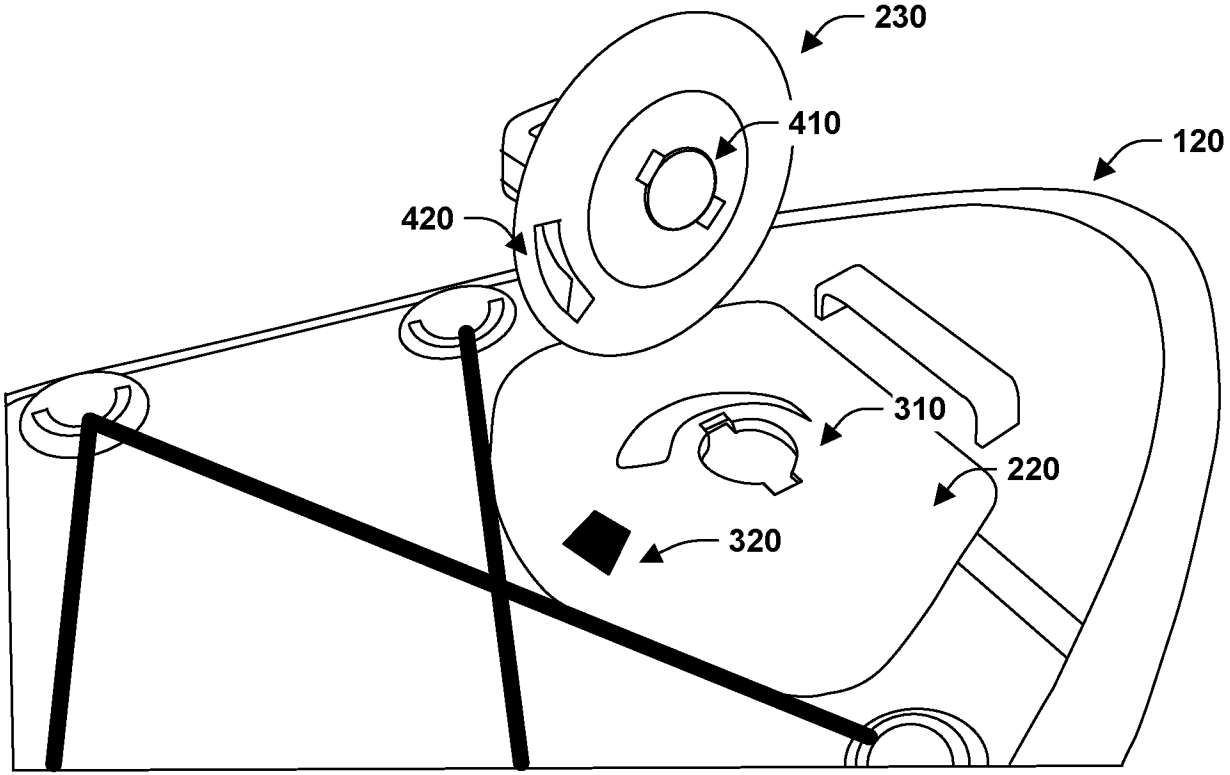
FIG. 4 depicts an example connection member relative to an example plate and paddleboard.
Figure 5:
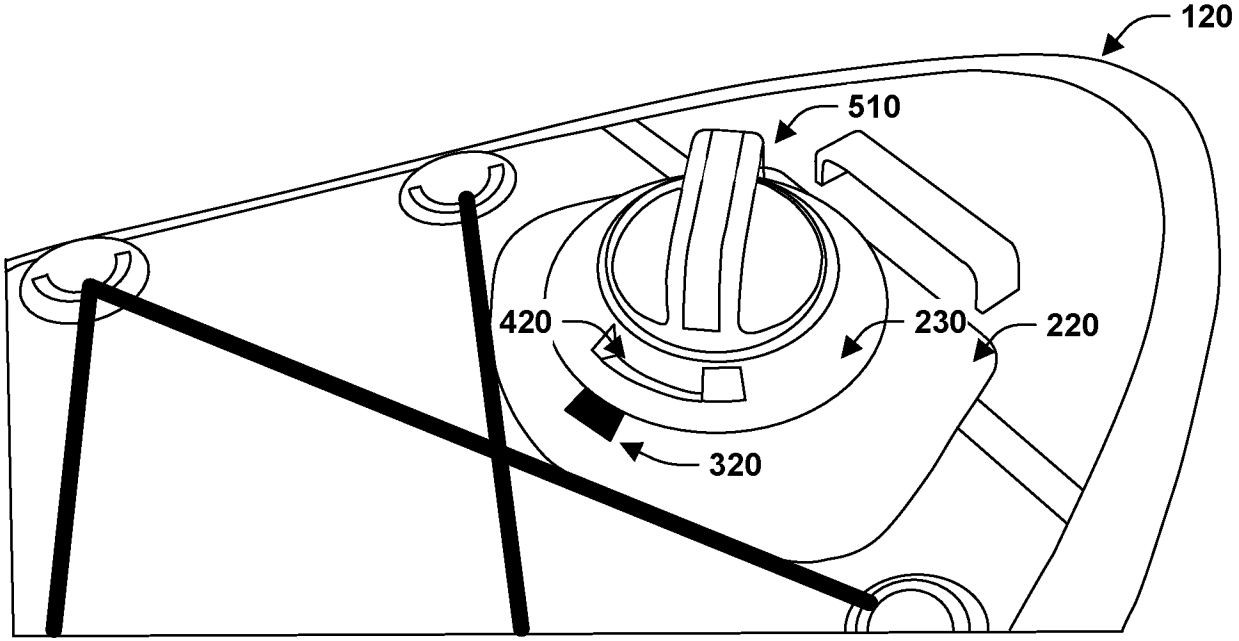
FIG. 5 illustrates positioning of an example connection member relative to a plate.

FIG. 4 illustrates the underside view of the connector member 230 in addition to the top section of the paddleboard 120 and plate 220, as described in FIG. 3. The connector member 230 includes an extended bottom portion 410 (e.g., t-shaped) that matches a receiving aperture 310 on the plate 220. The extended portion 410 can be placed inside the receiving aperture, and the connector member 230 can be rotated or turned to attach the board connector to the plate. Rotation can cause the fins of the extended bottom portion 410 to latch under the plate 220 or in a grove in the plate 220 that accepts the fins. In one embodiment, the rotation can be a quarter turn or a ninety-degree rotation. Further, the connector member 230 can include an aperture 420 that interacts with a protruded locking tab 320 on the plate 220 to further aid in locking the board connector 230 to the plate 220. Rotating the extended bottom portion 410 within the aperture 310 can also engage the locking tab 320 with the aperture 420. In one instance, the locking tab 320 can be compressed within the aperture 420, in which compressive friction prevents undesired rotation and unlocking the connector member 230. In another embodiment, the locking tab can include a lip or clip that engages with a portion of the connector member 230 through the aperture 420. For example, the apertures 420 can include three parts, a first part to initially accept the locking tab, a second part that holds the locking tab in place, and a third part to transition between the first part and the second part and vice versa when the connector member 230 is rotated FIG. 5 depicts the positioning of the connection member 230 over the plate 220 as part of an attachment process. The top portion of the connection member includes an extended handle portion 510 integrated on top of a circular base. The handle portion 510 serves multiple purposes. In one instance, the handle portion 510 can aid human grasping and positioning of the connection member over the plate 220. As described later herein, the handle portion 510 also functions to receive a boom.

Figure 6:
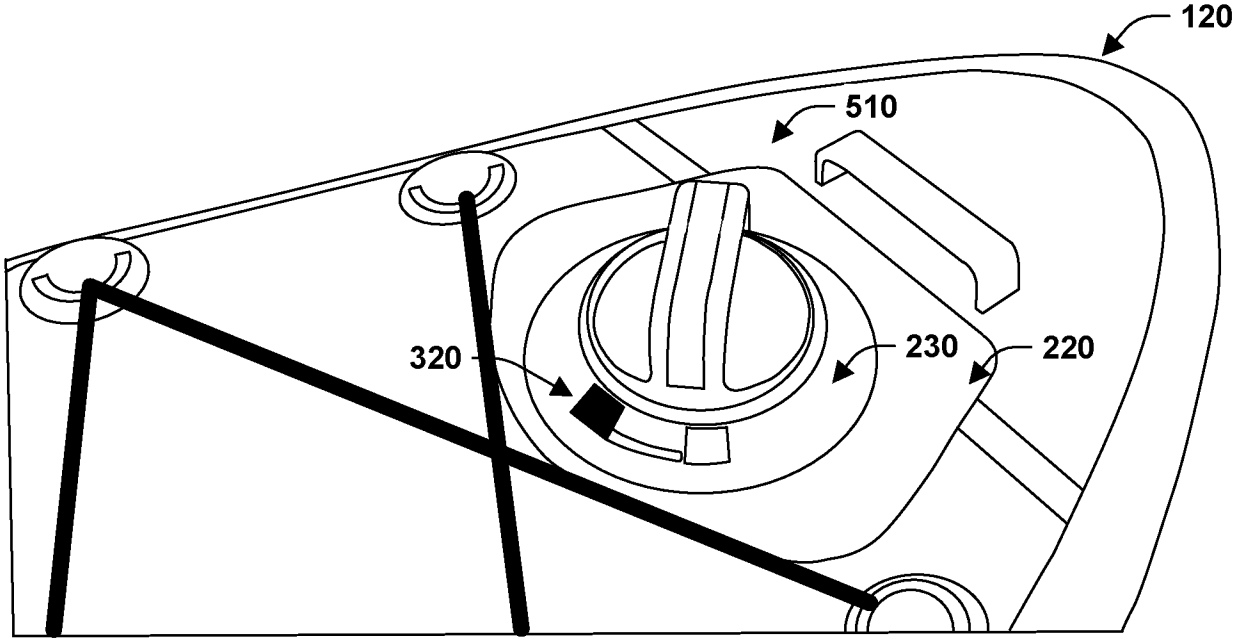
FIG. 6 depicts attachment of an example connection member to a plate.

FIG. 6 illustrates further positioning of the connection member 230 on the plate 220. The locking tab 320 is inserted through the aperture 420 of the connection member. Turning the connection member 230 clockwise with the handle portion 510 further holds the connection member 230 in place by way of the locking tab 320. To remove the connection member 230, the connection member 230 can be turned counterclockwise, disengaging with the locking tab 320 and permitting the connection member to be lifted off the plate 220.

Figure 7:
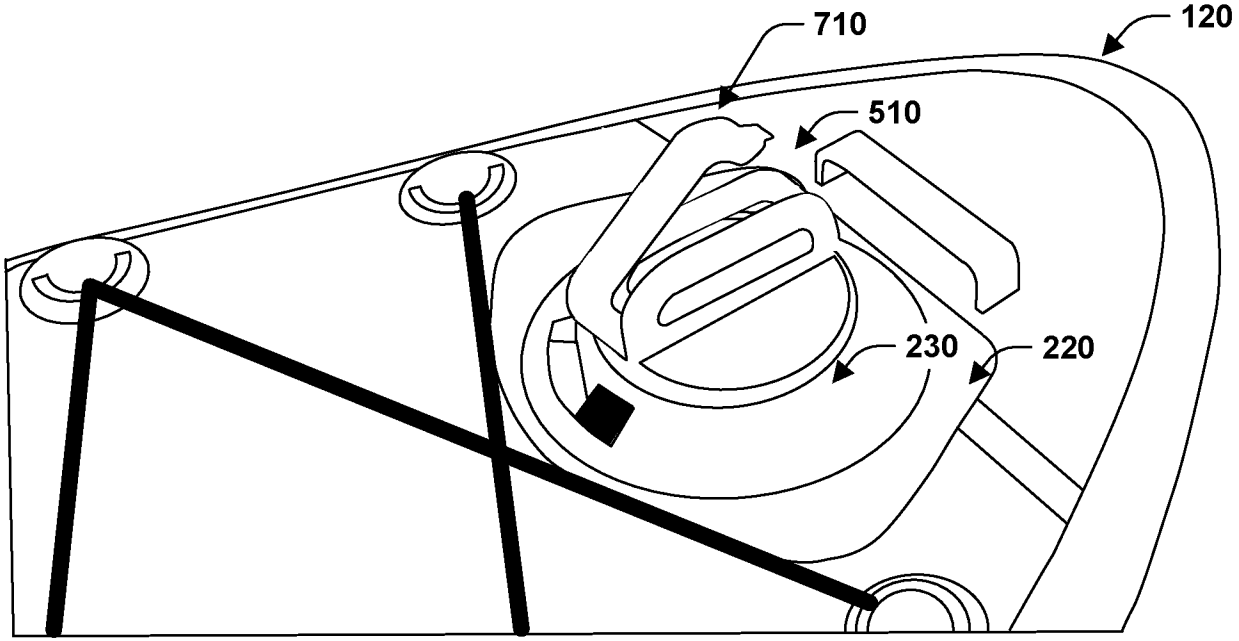
FIG. 7 illustrates an example locking mechanism of a connector member.

FIG. 7 shows a portion of the paddleboard 120, including a plate 220 and a connection member 230 attached to the plate 220. The handle portion 510 includes a boom locking mechanism 710. In one embodiment, the locking mechanism 710 comprises a center segment of the handle portion 510. The locking mechanism 710 is configured to pivot around an axis at one end of the handle portion such that the locking mechanism 710 can be moved up and down. Moving the locking mechanism 710 up corresponds to an open, released or unlocked state. Moving the locking mechanism 710 down corresponds to closed or locked state. The locking mechanism 710 also includes a portion opposite the pivot side that holds the locking mechanism 710 in a closed state. For example, the locking mechanism 710 can include a protruding portion that snaps into an aperture on the handle portion of the connection member 230. The locking mechanism 710 can also be designed to break or release in case of a catastrophe. In other words, if something goes wrong on the water the locking mechanism can fail or release so the contents of the paddleboards remain intact and stable.

Figure 8:
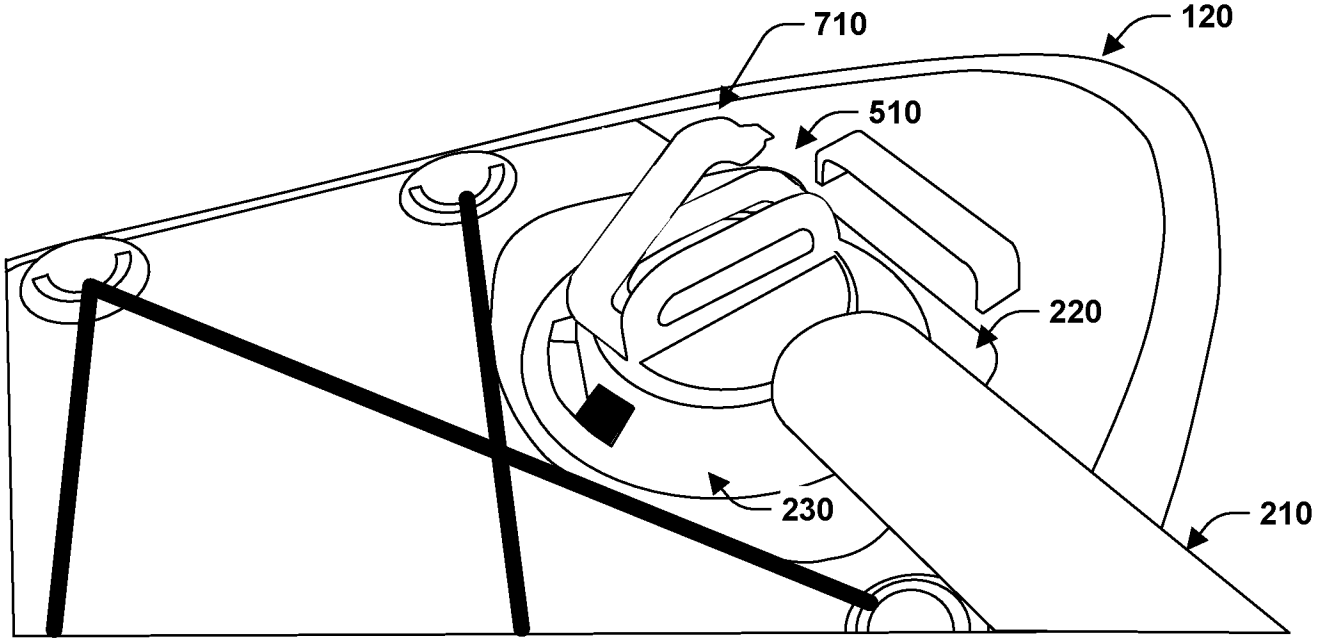
FIG. 8 depicts positioning of an example boom relative to a connector member.

FIG. 8 illustrates a portion of the paddleboard 120 including a plate 220, connection member 230, handle portion 510, and locking mechanism 710. The locking mechanism 710 is shown in an unlocked or open state. Further depicted is an end portion of a boom 210. The boom 210 can be positioned such that the end of the boom 210 passes into and through the apertures associated with the handle portion 510.

Figure 9:
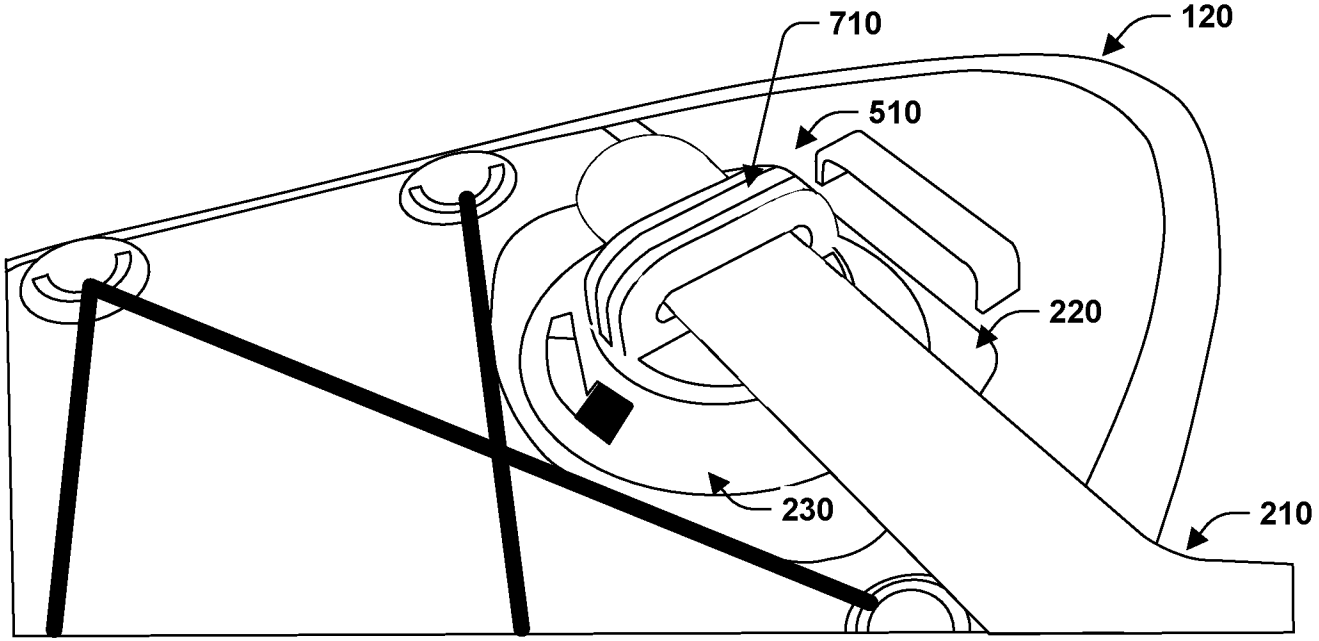
FIG. 9 illustrates engagement of a locking mechanism to hold a boom.

FIG. 9 depicts the portion of the paddleboard 120 including a plate 220, connection member 230, handle portion 510, locking mechanism 710, and boom 210. Here, one end of the boom 210 is inserted through handle portion apertures at a desired distance. The length of the boom end inserted through and past the handle portion apertures controls how close a connected paddleboard will be to the paddleboard 120. Stated differently, spacing between a first and second paddleboard can be adjusted by positioning more or less of the particular length of the boom 210 into an aperture on a connector member. FIG. 9 also illustrates the locking mechanism 710 in a closed or locked position. The locking mechanism 710 can exert a force on the end of the boom 210 to hold it in place and prevent it from sliding back through the handle portion apertures. Further, the locking mechanism 710 can exert a frictional force that prevents movement.

Alternate Embodiments

Figure 10:
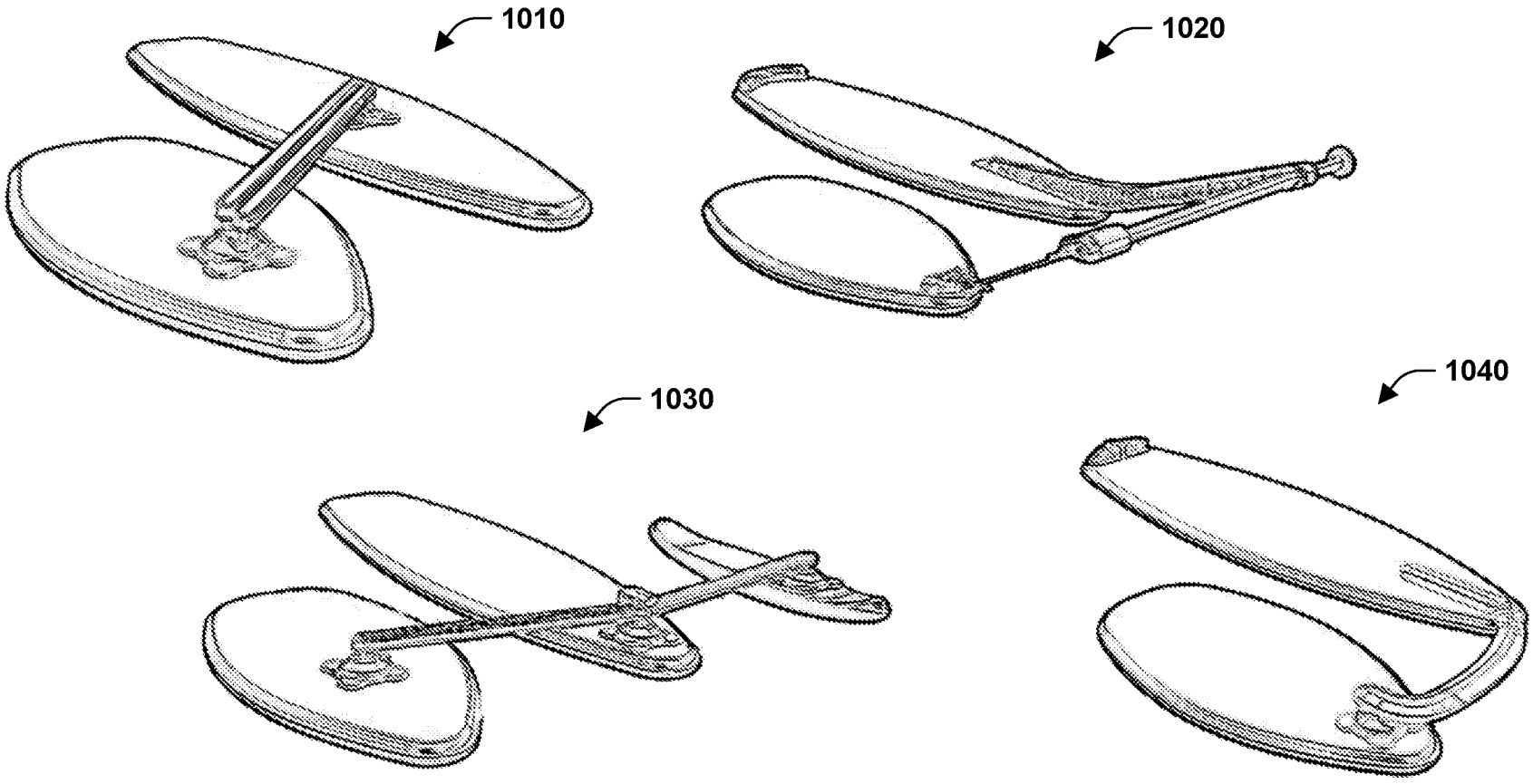
FIG. 10 shows several example alternative embodiments of paddleboard connection.

Aspects of the subject disclosure are not limited to the embodiment of FIG. 1 and as subsequently described with respect to FIGS. 2-8. FIG. 10 illustrates several alternative non-limiting embodiments. Embodiment 1010 utilizes parallel bars or booms affixed to the middle of one paddleboard and toward the front of another. In one instance, the parallel bars can be configured to move independently to provide a type of independent suspension. Embodiment 1020 includes a towline attached to a second paddleboard that can be pulled or pushed by a first paddleboard. Here, counterweights can be used, if needed, to offset the weight of the tow bar structure. Embodiment 1030 depicts a boom connected to a second paddleboard, which travels through an aperture on a first paddleboard to a flotation device on the opposite side of the second paddleboard. The boom and floatation device allow independent movement and stability while also allowing movement to be powered by the first paddleboard. Embodiment 1040 employs an arm that resembles a letter "J" connected to the front of the first and second paddleboards and a counterweight to offset the arm weight. Of course, these are only a few examples of many alternative embodiments.

Example Paddleboard Connection Method

Figure 11:
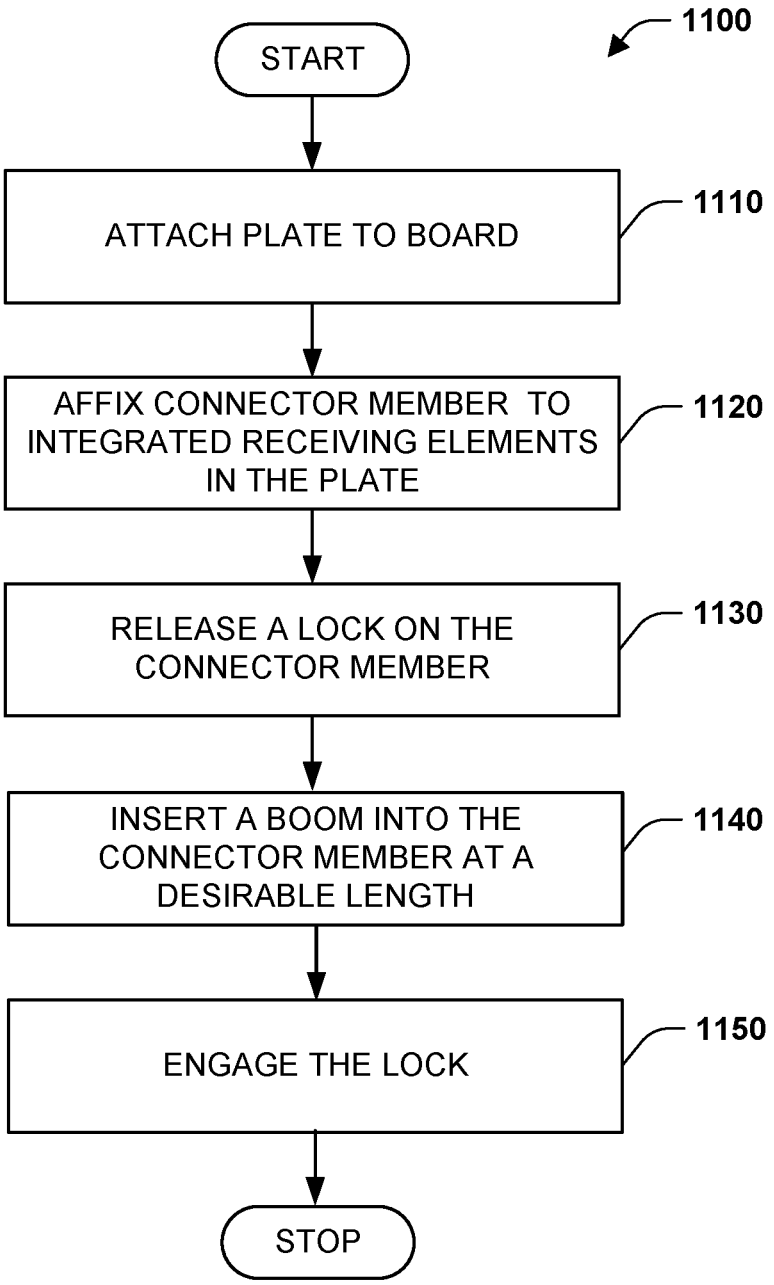
FIG. 11 is a flow chart diagram of an example method of connecting paddleboards.

In view of the paddleboard connection embodiments described above, methods that may be implemented in accordance with the disclosed subject matter will be better appreciated with reference to flow chart diagrams of FIG. 11. While, for purposes of simplicity of explanation, the methods show and describe a series of blocks, it is to be understood and appreciated that the disclosed subject matter is not limited by the order of the blocks, as some blocks may occur in different orders and/or concurrently with other blocks from what is depicted and described herein. Moreover, not all illustrated blocks may be required to implement the methods described hereinafter.

Turning attention to FIG. 11, a method 1100 of connecting paddleboards is illustrated. At block 1110, a plate is attached to a paddleboard. In one instance, the plate can correspond to plate 220 of FIGS. 2-9. The plate can be temporarily or permanently attached. For example, an adhesive can permanently attach the plate to a paddleboard. Alternatively, an adjustable clamp can be employed to hold the plate in place, or a hook and loop fastener (e.g., Velcro) affixed to the board and plate can be employed.

The method 1100 next proceeds to block 1120, where a connector member is attached, such as connector member 230, as shown in FIGS. 2-9. The connector member can be configured to interact with one or more receiving elements provided by the plate. For example, the connector member can include an extended t-shaped portion that engages with a receptacle on the plate, such as an aperture, such that when the connector member is rotated, the connector member is held in place. Further, the plate can include an extended locking tab that interacts with an aperture or slot on the connector member such that rotation of the connector member further locks the connector member to the plate.

The method 1100 continues to block 1030, where a locking mechanism on the connector member is released. For example, the locking mechanism can correspond to locking mechanism 710, as described with respect to FIGS. 7-9. The locking mechanism can be proximate to and interact with an aperture on the connector member. For example, the locking mechanism can operate with respect to apertures that form a handle portion of the connector member. The locking mechanism can be released, opened, or unlocked to permit the acceptance of an object or portion of an object in the aperture.

Next, the method continues to block 1140, where a portion of a boom is inserted into the aperture on the connector member. For example, the aperture can correspond to the apertures associated with the handle portion of the connector member. The boom can include two ends of the same or varying lengths. For example, the boom can correspond to the boom 210 of FIG. 2. One boom end can be inserted into the aperture at a desired distance. The distance can affect how far apart two paddleboards are from each other.

The method 1100 continues at block 1050, where the lock is engaged. Engaging or closing the lock holds the boom in a position either by friction or some mechanical mechanism (e.g., pin, latch). For example, the locking mechanism 710 of FIGS. 8 and 9 can be closed and latched to hold the boom 210 in position.

Method 1000 has been described concerning one paddleboard. For example, a plate is affixed to a paddleboard, the connector member is attached to the plate, and the connector member accepts and holds one end of a boom. The same actions can be performed on a second paddleboard to enable the connection. Further, once the plate is installed, the method can be simplified, and the boom and the connector members can be easily removed and reattached.

Note that FIG. 11 is just one example of a method, and other methods including fewer, additional, or alternative steps are possible consistent with this disclosure.

Additional Considerations

The preceding description is provided to enable any person skilled in the art to practice the various embodiments described herein. The examples discussed herein are not limiting of the scope, applicability, or embodiments set forth in the claims. Various modifications to these embodiments will be readily apparent to those skilled in the art, and the generic principles defined herein may be applied to other embodiments. For example, changes may be made in the function and arrangement of elements discussed without departing from the scope of the disclosure. Various examples may omit, substitute, or add various procedures or components as appropriate. For instance, the methods described may be performed in an order different from that described, and various steps may be added, omitted, or combined. Also, features described with respect to some examples may be combined in some other examples. For example, an apparatus may be implemented, or a method may be practiced using any number of the aspects set forth herein. In addition, the scope of the disclosure is intended to cover such an apparatus or method practiced using other structure, functionality, or structure and functionality in addition to, or other than, the various aspects of the disclosure set forth herein. It should be understood that any aspect of the disclosure disclosed herein may be embodied by one or more elements of a claim.

The conjunction "or" as used in this description and appended claims is intended to mean an inclusive "or" rather than an exclusive "or," unless otherwise specified or clear from the context. In other words, "'X' or 'Y'" is intended to mean any inclusive permutations of "X" and "Y." For example, if "'A' employs 'X,'" "'A employs 'Y,'" or "'A' employs both 'X' and 'Y,'" then "'A' employs 'X' or 'Y'" is satisfied under any of the preceding instances.

Furthermore, to the extent that the terms "includes," "contains," "has," "having," or variations in form thereof are used in either the detailed description or the claims, such terms are intended to be inclusive in a manner similar to the term "comprising" as "comprising" is interpreted when employed as a transitional word in a claim.

The following claims are not intended to be limited to the embodiments shown herein, but are to be accorded the full scope consistent with the language of the claims. Within a claim, reference to an element in the singular is not intended to mean "one and only one" unless specifically so stated, but rather "one or more." Unless specifically stated otherwise, the term "some" refers to one or more. No claim element is to be construed under the provisions of 35 U.S.C. § 112(f) unless the element is expressly recited using the phrase "means for" or, in the case of a method claim, the element is recited using the phrase "step for." All structural and functional equivalents to the elements of the various aspects described throughout this disclosure that are known or later become known to those of ordinary skill in the art are expressly incorporated herein by reference and are intended to be encompassed by the claims. Moreover, nothing disclosed herein is intended to be dedicated to the public, regardless of whether such disclosure is explicitly recited in the claims.

What is claimed is:

1. A paddleboard connection apparatus, comprising:

a plate attachable to a paddleboard with an integrated receiving element;

a connector member with an aperture and a releasable lock removably affixable to the plate through the integrated receiving element; and a rigid boom with a first end insertable through the aperture and held in place by the releasable lock, wherein the rigid boom includes a first straight portion, an angled portion, and a second straight portion, wherein the first straight portion and the second straight portion are insertable into the aperture of the connector member.

2. The paddleboard connection apparatus of claim 1, further comprising a second plate and second connector member associated with a second paddleboard, wherein a second end of the rigid boom is insertable through the aperture of the second connector member and affixable in place by the releasable lock of the second connector member.

3. The paddleboard connection apparatus of claim 1, wherein the angled portion of the rigid boom includes an aperture substantially the length of the angled portion.

4. The paddleboard connection apparatus of claim 1, wherein the plate is attachable to two sides of the paddleboard.

5. The paddleboard connection apparatus of claim 3, wherein the plate is removably attachable to the paddleboard.

6. The paddleboard connection apparatus of claim 1, wherein the integrated receiving element of the plate includes a t-shaped aperture for receiving a t-shaped extended portion of the connector member.

7. The paddleboard connection apparatus of claim 1, wherein the plate includes a locking tab that extends through an aperture of the connector mechanism that, when engaged by rotation, prevents subsequent rotation of the connector mechanism.

8. The paddleboard connection apparatus of claim 1, wherein the aperture is associated with a handle portion of the connector member.

9. The paddleboard connection apparatus of claim 8, wherein the handle portion comprises the releasable lock.

10. The paddleboard connection apparatus of claim 9, wherein the releasable lock releases automatically based on a force that satisfies a threshold.

11. A method of connecting paddleboards, comprising:

affixing a first plate to a first paddleboard;

attaching a first connection member to the first plate through a first integrated receiving element; and inserting a first end of a boom through a first aperture of the first connection member, wherein attaching the first connection member to the first plate, comprises:

positioning the first connection member relative to the first plate such that an extended portion of the first connection member engages with the first integrated receiving element of the first plate; and rotating the first connection member to engage the first integrated receiving element.

12. The method of claim 11, wherein rotating the first connection member further engages a locking tab of the first plate that prevents further rotation.

13. The method of claim 12, further comprising:

opening a locking mechanism before inserting the first end of the boom through the first aperture of the first connection member;

positioning the first end of the boom with respect to the first aperture; and closing the locking mechanism, wherein the locking mechanism prevents movement of the first end of the boom.

14. The method of claim 13, wherein inserting the first end of the boom through the aperture comprises inserting the first end of the boom through an aperture formed by a handle portion of the first connection member.

15. The method of claim 11, further comprising affixing a second plate to a second paddleboard;

attaching a second connection member to the second plate through a second integrated receiving element; and inserting a second end of the boom through a second aperture of the second connection member.

16. A paddleboard connection apparatus, comprising:

a plate attachable to a paddleboard with an integrated receiving element;

a connector member comprising an extended portion, an aperture in a handle portion of the connector member, and a releasable locking mechanism, wherein the connector member is removably affixable to the plate through the extended portion that interacts with the integrated receiving element; and an angled boom with a first end insertable through the aperture and held in place by the releasable locking mechanism.

17. The paddleboard connection apparatus of claim 16, wherein the extended portion is t-shaped and attaches to a t-shaped aperture of the integrated receiving element through rotation.

18. The paddleboard connection apparatus of claim 17, wherein the plate further comprises a locking tab, the connector member includes an aperture that accepts the locking tab, and rotation of the connector member engages the locking tab to prevent further rotation until the locking tab is unlocked.

* * * * *